United States Patent [19]

Patton et al.

[11] 4,342,498

[45] Aug. 3, 1982

[54] ELECTRICAL SOCKET

[75] Inventors: George A. Patton, Enka; Richard C. Muehling, Asheville, both of N.C.

[73] Assignee: Akzona Incorporated, Asheville, N.C.

[21] Appl. No.: 180,720

[22] Filed: Aug. 25, 1980

Related U.S. Application Data

[63] Continuation of Ser. No. 23,804, Mar. 26, 1979, abandoned.

[51] Int. Cl.[3] ..... H01R 13/16

[52] U.S. Cl. ..... 339/256 R; 339/259 R

[58] Field of Search ..... 339/256 R, 259, 262

[56] References Cited

U.S. PATENT DOCUMENTS

| | | | |
|---|---|---|---|
| 2,448,268 | 8/1948 | Larkin | 339/262 R |
| 3,112,146 | 11/1963 | Barnhart | 339/256 R |
| 3,370,265 | 2/1968 | Berg | 339/256 R |
| 3,663,931 | 5/1972 | Brown | 339/256 R |
| 3,836,947 | 9/1974 | Yeager | 339/259 R |
| 3,927,928 | 12/1975 | Pustell et al. | 339/256 R |

FOREIGN PATENT DOCUMENTS

| | | | |
|---|---|---|---|
| 7413684 | 4/1976 | Netherlands | 339/256 R |
| 665381 | 1/1952 | United Kingdom | 339/259 R |

*Primary Examiner*—Joseph H. McGlynn

*Attorney, Agent, or Firm*—Francis W. Young; David M. Carter

[57] ABSTRACT

An improved electrical socket for providing superior electrical and mechanical contact to a mating electrical pin. The socket includes an elongated metallic box which receives the pin contact. An elliptical spring is secured in the box by ear pairs projecting from the opposing ends of the elliptical spring. A pair of cantilevered beams, integral with the top of the box, are bent slightly downward and have their free ends in contact with the ends of the elliptical spring. The cantilevered beams thus form a pair of single leaf springs. The elliptical spring and the cantilevered beams cooperate with each other to provide a suitable force on the inserted pin over a wide range of deflections of the springs.

14 Claims, 9 Drawing Figures

ELECTRICAL SOCKET

This is a continuation of application Serial No. 23,804, filed March 26, 1979 now abandoned.

BACKGROUND OF THE INVENTION

This invention relates to improved socket contacts for electrical connectors. More particularly, it relates to improved electrical sockets especially suitable for use in telecommunication and computer connectors, the sockets having greatly improved constancy of spring force per unit length of deflection of a spring means contained therein.

Electrical sockets or receptacles, as they are sometimes referred to, are essential elements of electrical connectors. Normally one end of the socket terminates a cable conductor by using solder or some other technique. The other end is open and is adapted to receive a corresponding electrical pin contact such as a wire-wrap post which is mounted in a member for completing a circuit. Socket contacts are designed to insure low and stable electrical resistance through the connector, as well as mechanical integrity for the connection. Sockets have been made to provide these features by using a stamped and formed sheet metal box with a single elliptical spring fixed in the box for providing spring force downward on the pin.

An example of such a socket is shown in U.S. Pat. No. 3,370,265 issued to Berg and assigned to Berg Electronics, Inc. The Berg patent shows a stamped and formed rectangular box receiving a cruciformed-shaped tapered elliptical spring. The spring is held in the box, in one embodiment by the use of ears on each end of the spring, and in another embodiment by lateral ears in the middle of the spring. The use of tapered elliptical springs in sockets is also taught in Mechanical Design and Systems Handbook, Section 33.31, copyrighted in 1964 by McGraw-Hill, Inc., Library of Congress Catalog No. 62-21118. One drawback to the Berg design is that in order to obtain acceptable force on the inserted pin over a range of spring deflection, Berg normally uses a beryillium copper alloy as the spring material. This alloy is expensive to use.

Another example of the use of an elliptical spring to provide mechanical and electrical contact to a pin is taught in U.S. Pat. No. 3,140,141 issued to Nava and assigned to Akzona Incorporated, assignee of the present invention. The Nava patent shows a machined socket body rather than a stamped box, as taught in Berg, and provides a single elliptical spring held in the socket body by a shroud.

Stamped sockets have also been provided which utilize spring arms extending into the cavity of the box to provide spring contact directly with the pin. Examples of such contacts are shown in U.S. Pat. No. 3,955,689 issued to Licht and assigned to the Bunker Ramo Corporation and U.S. Pat. No. 4,076,369 issued to Ostapovitch and assigned to Northern Telecom Limited. Each of these patents show socket contacts having spring arms integral with the main body of the socket, with the free ends of the arms facing inwardly towards the center of the contact.

U.S. Pat. No. 3,384,866 also issued to Nava and assigned to Akzona Incorporated, shows a socket having a spring member with a flat portion adapted to engage a corresponding electrical pin, and a pair of reversely turned arms integral with the flat portion of the spring, for providing spring pressure on the pin. As in the previously discussed Nava patent, the socket is machined rather than stamped.

It is, therefore, desirable to provide an electrical socket which is an improvement over the prior art.

OBJECTS OF THE INVENTION

It is a general object of the invention to provide an improved electrical socket contact.

It is another object of this invention to provide a socket having improved electrical and mechanical characteristics.

It is still another object of this invention to provide an electrical socket having improved uniformity of spring force per unit distance of deflection of a spring contained in the socket.

It is another object to provide the desired spring contact force in a socket over a wide range of spring deflection without the use of exotic and expensive material.

It is a further object of this invention to provide a socket contact having acceptable mechanical and electrical characteristics yet which may be made with less expensive materials than most prior art sockets use.

It is another object of this invention to provide a sheet metal stamped box and contact which are inexpensive to manufacture and which have improved characteristics.

It is still another object to provide a plurality of sockets which are provided on a carrier using inexpensive materials.

It is another object to provide an improved socket and wire termination system.

SUMMARY OF THE INVENTION

In accordance with one form of this invention there is provided an electrical socket, including an elongated metallic box. The box is opened on at least one end for receiving an associated electrical pin contact. An inwardly curved spring member is held inside the box for engaging the pin. At least one inwardly directed cantilevered beam, associated with the box has its free end in contact with the curved spring for providing additional spring action, thus enhancing the electrical and mechanical contact between the socket and the pin. A plurality of such sockets may be provided on a carrier with transistion tails coupling the sockets to the carrier.

BRIEF DESCRIPTION OF THE DRAWINGS

The subject matter which is regarded as the invention is set forth in the appended claims. The invention itself, however, together with further objects and advantages thereof may be better understood with reference to the following description taken in conjunction with the accompanying drawings in which:

DESCRIPTION OF THE PREFERRED EMBODIMENT

Figure 1:
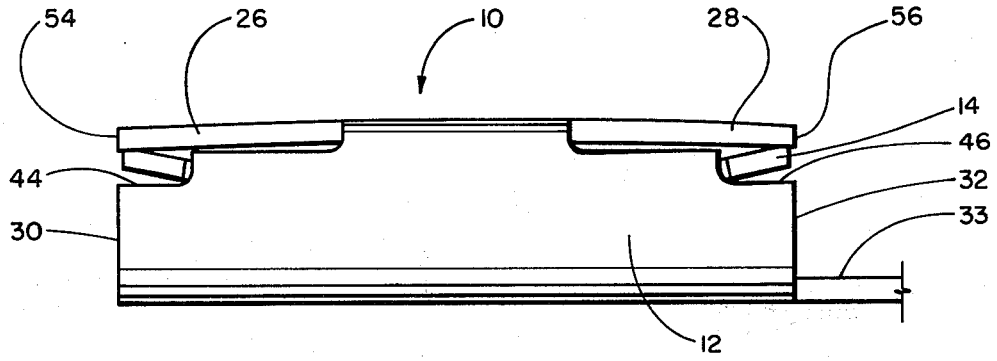
FIG. 1 is a side elevational view of the socket contact showing some of the features of the present invention.
Figure 2:
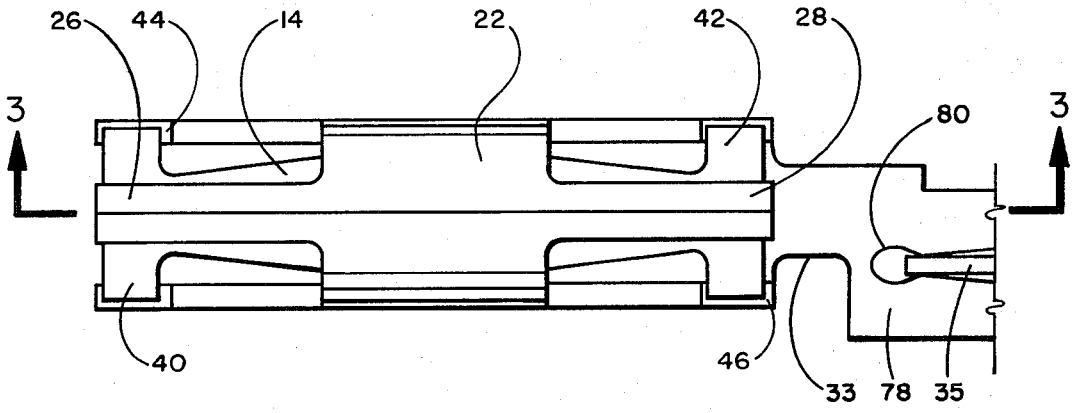
FIG. 2 is a top view of the socket contact of FIG. 1.
Figure 4:
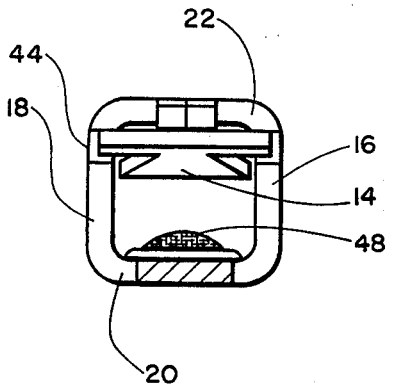
FIG. 4 is an end elevational view of the socket contact of FIG. 1.
Figure 9:
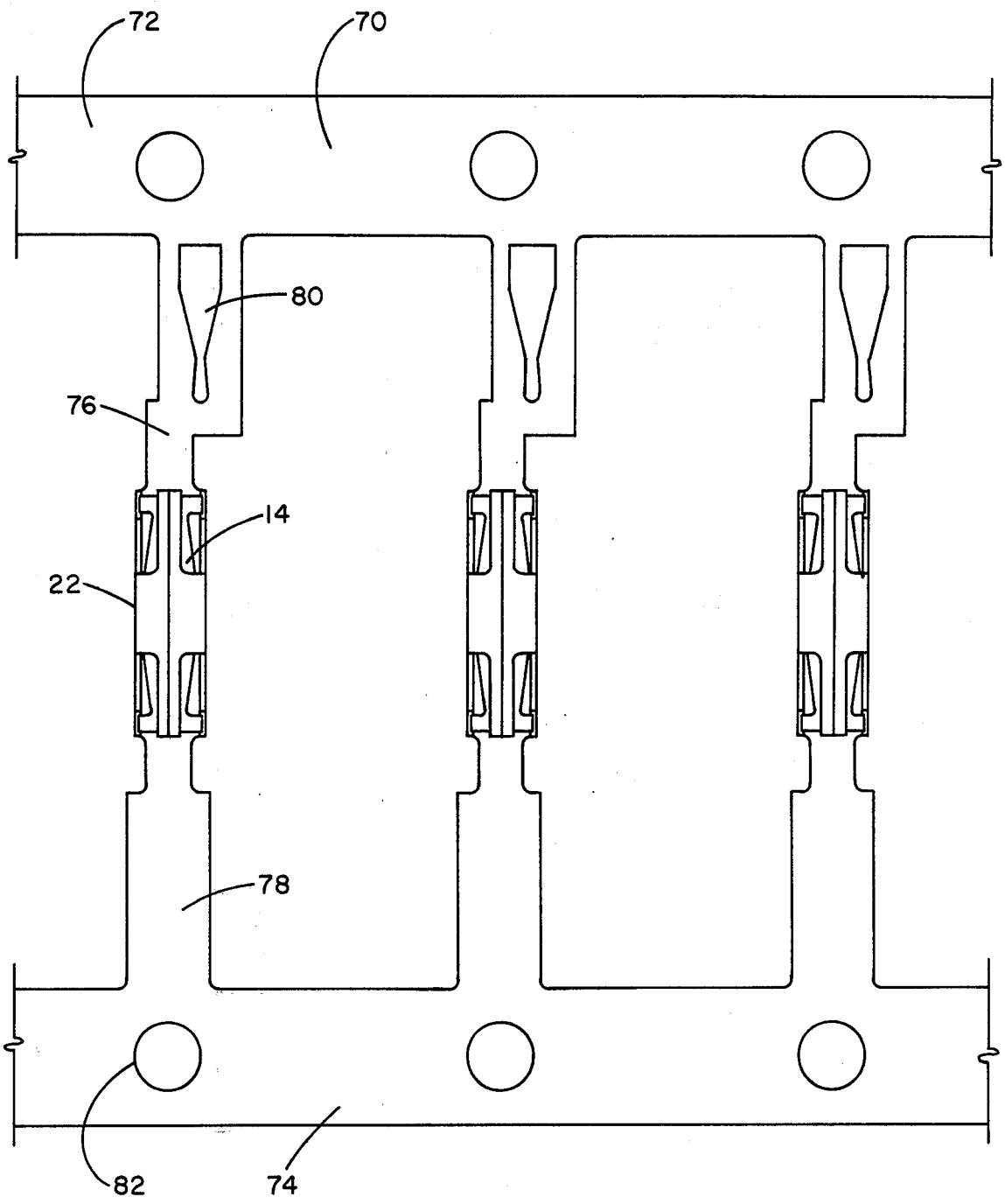
FIG. 9 is a plan view of a plurality of sockets, one of which being shown in FIG. 2, on a carrier.

Referring now more particularly to FIG. 1, there is provided electrical socket 10, including elongated body member or box 12 and elliptical spring member 14. As better illustrated in FIG. 4, the socket box includes a pair of side walls 16 and 18 and a base 20. FIG. 2 shows that the box further includes a top 22 which, in this embodiment, acts only as a partial covering of the remaining side of the box. The box 10 is made by stamping and forming flat sheet metal and is held together along seam 24, which is along the top of the box. These sockets may be provided on a carrier which is shown in FIG. 9 and which will be discussed below. A pair of cantilevered beams 26 and 28 are integral with and thus a part of the body of the socket box. The ends 30 and 32 of the box are open, forming retangular entryways, either of which is adapted to receive a pin contact. The box is designed to receive pins of various shapes, such as round or square, for example, 0.025 inch by 0.025 inch. The extension 33 from the base 20 of the box is adapted to have electrical conductor 35 terminated thereto. In this embodiment conductor 35 is wedged into termination slot 80, which has been stamped in straight end 78 of extension 33. A better understanding of this termination may be made by referring to application Ser. No. 918,813 filed June 26, 1978 and assigned to Akzona Incorporated, assignee of the present invention.

Figure 5:
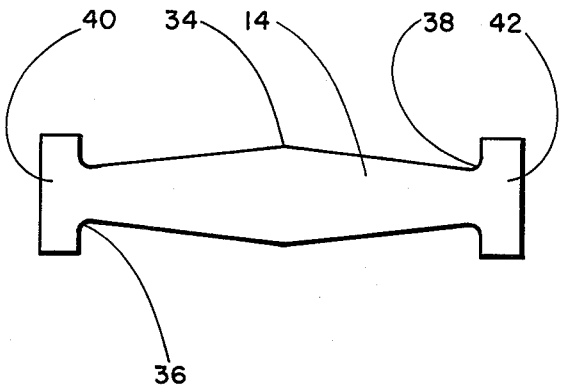
FIG. 5 is a top view of the curved spring member utilized in the socket contacts shown in FIGS. 1–4.
Figure 6:
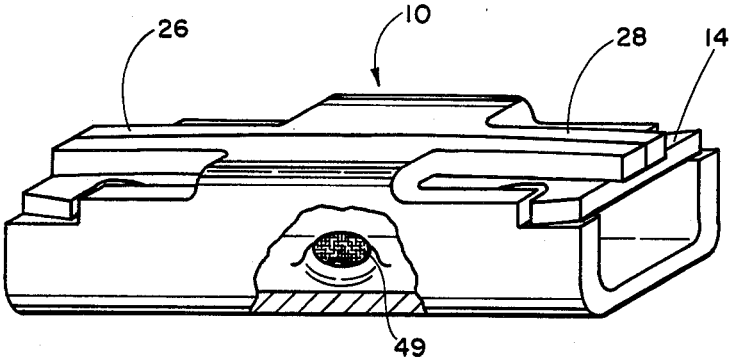
FIG. 6 is a perspective view of the socket contact shown in FIG. 1.

An elliptical spring, such as the one shown in FIG. 5, is received in the box. Elliptical spring 14 is tapered from its wide mid-section 34 down to its narrow ends 36 and 38. Each end of the elliptical spring includes ear pairs 40 and 42. As shown in FIG. 2, these ear pairs are disposed in slots 44 and 46 of the socket box for retaining the spring in the box. Elliptical spring 14 is bowed inwardly towards the center of the socket box. The wide central portion 34 of this spring 14 is approximately alligned with dimple 48, which is formed by a embossment in the base 20 of the socket. The dimple may include a gold dot 49 as a cap to prevent oxidation and to improve electrical conductivity between the pin and the socket.

Figure 3:
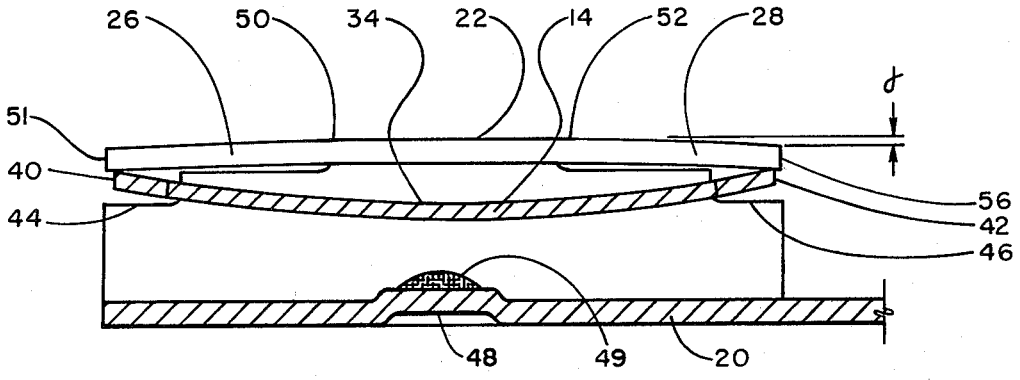
FIG. 3 is a cross-sectional side elevational view of the socket contact in FIG. 2 taken along lines AA.

As can be seen in FIG. 3, each of the cantilevered beams 26 and 28 are pre-biased or deflected downwardly from the horizontal as indicated by the angle alpha; the horizontal being represented by the flat plane of top 22 of the socket. The bends 50 and 52 of the beams occur approximately at the junction between the beams and the top of the socket box. These cantilevered beams thus form a pair of single leaf spring members with the free ends 54 and 56 being respectively in contact, in this embodiment, approximately with the ends of the ear pairs 40 and 42 of the elliptical spring 14. As will be explained below, the cantilevered beams and the elliptical spring member cooperate with each other to provide improved electrical and mechanical contact with an inserted electrical pin. The beams also help to retain the elliptical spring in the box.

Figure 7:
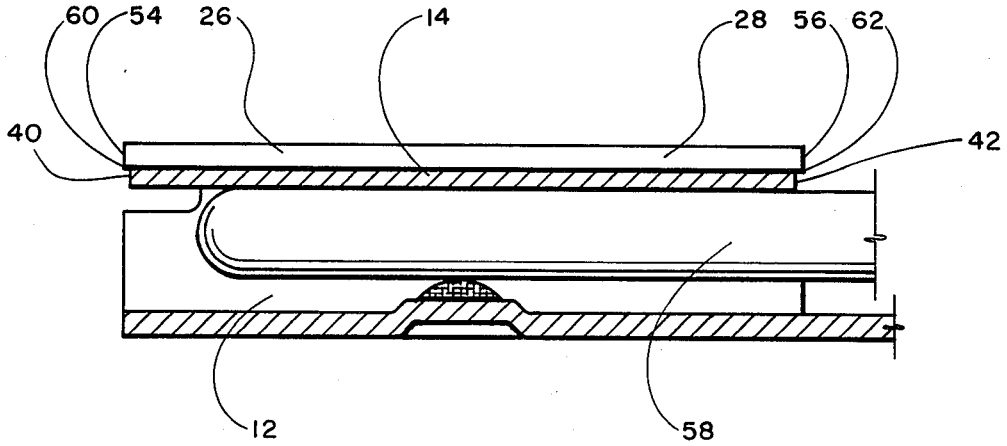
FIG. 7 shows the cross-sectional view of the socket contact of FIG. 3 with a corresponding pin contact inserted in the socket.

FIG. 7 illustrates an electrical pin contact 58 having been inserted in the cavity of socket box 12. As can be seen, this particular pin contact is of a slightly oversized diameter and of a length to fully deflect upwardly to the horizontal both the elliptical spring member 14 and the cantilevered beams 26 and 28. Normal and smaller sizes of pins may also be used in taking advantage of the cooperation between the elliptical and cantilevered springs. Since there is substantial deflection of the elliptical spring member 14, it has been straightened out, forcing the eared free ends 40 and 42 near the free ends 54 and 56 of the cantilevered beams. Thus, in this embodiment, the elliptical spring is designed to remain within the limits of the cantilevered spring ends. The beams exert substantial force down on these elliptical springs approximately at positions 60 and 62 on the elliptical spring, or wherever such contact occurs depending on the relative lengths of the beams and elliptical spring, their bend angles, and the type of materials used. Thus, the forces provided by the combination of the cantilevered beams and the elliptical spring bear down on the pin to provide a greatly improved electrical and mechanical contact with the pin when inserted in an electrical socket. As can be seen, with the deflection upwardly of the cantilevered beams the angle alpha between the beam and the horizontal top 22 goes to approximately zero degrees, again depending on the size of the pin.

Figure 8:
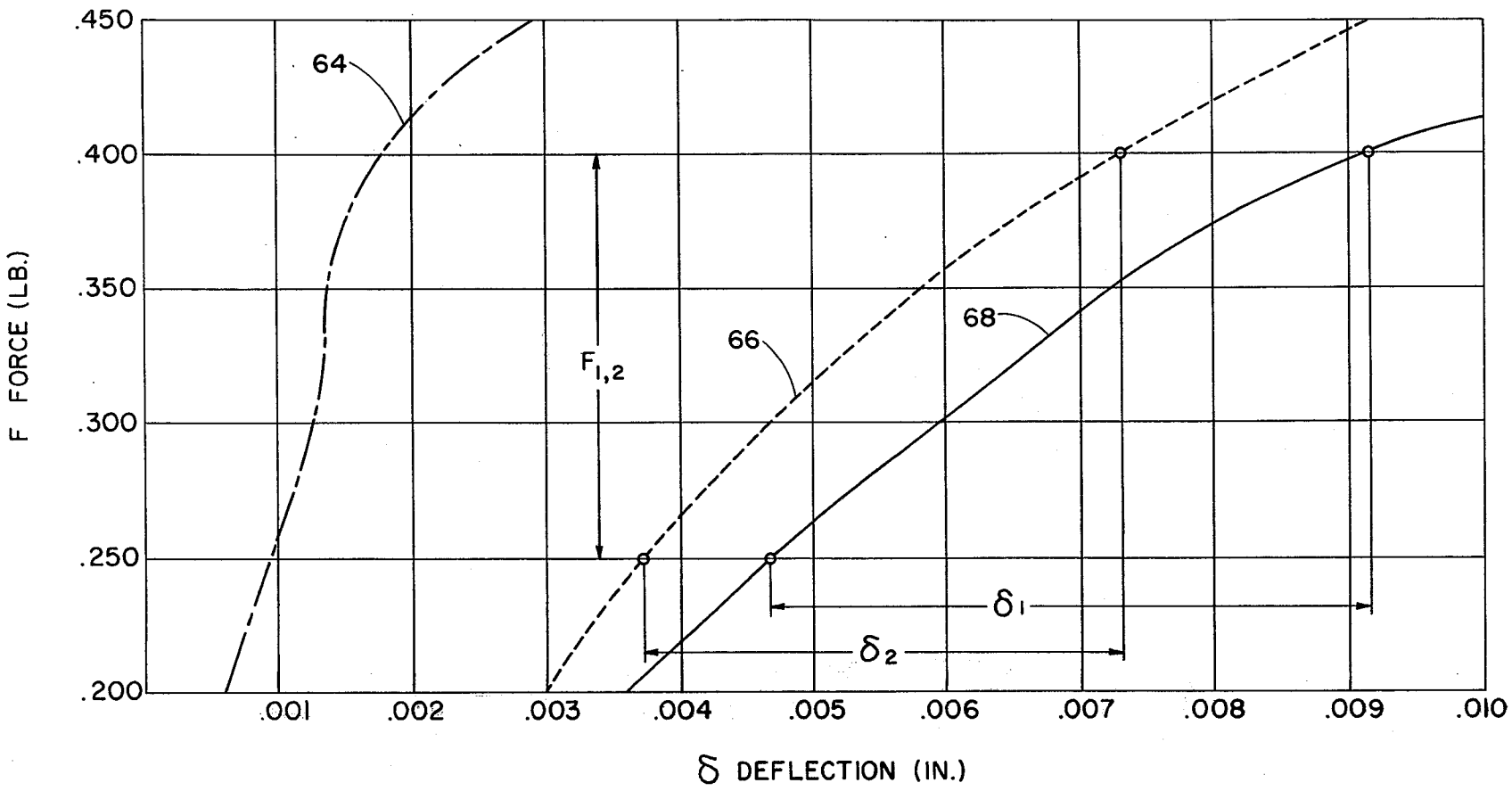
FIG. 8 is a graph of spring deflection v. force comparing some prior art sockets with a socket incorporating some of the features of the present invention.

FIG. 8 illustrates a graph showing the calculated spring force on the pin versus the deflection of spring means, comparing a socket with an elliptical spring only against one embodiment of the subject invention, as set forth in FIGS. 1–7 utilizing a pair of cantilevered beams and an elliptical spring. The force per unit deflection contribution of the cantilevered beams above is also illustrated. As can be seen, line 64, which illustrates the use of the cantilevered beams only, does not provide sufficient force to meet minimum electrical contact requirements. Line 66, which illustrates the use of an elliptical spring without the cantilevered beams, shows that an acceptable force range of from 0.250 lb. to 0.400 lb. may be met through deflections from about 0.0038 in. to about 0.0073 in. However, by the use of the socket of the subject invention, particularly using the dual cantilevered beams and the elliptical spring, as indicated by line 68, the same range of acceptable forces is achieved through a much larger range of spring deflection, i.e. from about 0.0047 in. to about 0.0091 in. This is particularly important when oversized pins, such as the one shown in FIG. 7, are used. The spring stress is much lower as the spring force becomes more constant over a given range of deflection. A decrease in stress will increase the life expectancy of the spring. Clearly line 68 shows a more constant force than line 66. Thus the force to deflection ratio is lower using the socket of the subject invention when compared to a single leaf spring socket. Thus, since pin contacts come in various sizes or diameters, due to manufacturing variations, the socket of the subject invention is capable of performing acceptably with a far greater degree of flexibility.

The socket contact illustrated above has been formed by known sheet metal stamping and forming procedure with the socket box 12 made of a nickel-copper (CA 725) alloy and the elliptical spring made of a 510 phosbronze alloy (CA 510). Dimple 48 was gold plated. The angle of curvature of the elliptical spring was approximately 25 degrees from its tangent and the angle of deflection of each of the cantilevered beams was approximately 10 degrees from horizontal.

Thus, it can be seen that independent spring forces have been combined to achieve a greatly improved electrical contact socket. Furthermore, the forces on the pin may be easily adjusted by simply varying the alpha angle, that is, the amount of spring bias in the cantilevered beams, thus making a readily adjustable socket.

Even more importantly, however, the decreased force to deflection ratio caused by the cantilevered beams permit the use of material in the elliptical spring which have lower modulii of elasticity and yield strength than prior sockets, such as the previously described Berg socket, and are much cheaper materials. For example, 510 phos-bronze which is used as a material in the preferred embodiment, has a modulus of elasticity of about 17.5×10 PSI and a yield strength of about 92 to 108×10 PSI while 170 beryllium copper, which is normally used by Berg, has a modulus of elasticity of about 18.5×10 PSI and a yield strength of about 120 to 140×10 PSI. The alloy 170 beryllium copper currently cost between twice and three times as much as 510 phos-bronze. The socket design of the subject invention thus enables one to manufacture a socket which out performs prior art sockets, and for a much lower cost. As stated previously, the sockets may be provided on a carrier such as carrier 70, as shown in FIG. 9. A plurality of sockets 22 are coupled to each rail 72 and 74 of the carrier through tails 76 and 78, which extend from respective ends of the socket. As stated previously, the socket 22 is symmetrical and thus capable of receiving a corresponding pin in either end. Thus the tails 76 and 78 extend from either end. However, when the socket 22 is to be inserted into an electrical connector, one of the tails, of course, must be clipped off. The tail for each socket acts as an electrical conductive path or transition between the socket and an electrical conductor. Applicant has found that it is advantageous to terminate the electrical conductor to the tail by the use of a slot such as slot 80. Of course, if tail 78 were utilized then a slot could also be punched in tail 78. The function of slot 80 and the termination to an electrical conductor is described and claimed in U.S. patent application Ser. No. 918,813 filed June 26, 1978 and is assigned to Akzona Incorporated, assignee of the present invention, and is hereby incorporated by reference. As can be seen, a portion of tail 76 is offset from the longitudinal axis of socket 22, while tail 78 is not offset. Thus one may use a socket having an offset tail or a straight tail depending on the need, particularly since, as stated previously, the socket may receive a pin contact from either end. The reason for the offset tail or transition element is in order to provide for the difference between the center-to-center distance between electrical conductors in a flat cable and sockets in a connector. For example, in the above-mentioned U.S. patent application Ser. No. 918,813, filed June 26, 1978, such a connector-to-cable relationship is described. Furthermore, the width of the tails 76 and 78 are wide enough so that the slot which is punched therein provides sufficient holding strength to hold the conductor which is to be inserted in the slot for proper termination. The carrier tails and socket, except for spring 14, are made from a single strip of nickel-copper alloy (CA 725). It has been found quite unexpectedly that this nickel-copper alloy with a thickness of approximately 0.0060 in. is of sufficient hardness and thickness, and in the case of the tails, the proper width, to provide the desired beam spring characteristics in the socket, as well as the desired characteristics for terminating the wire to a tail or transition member. The carrier socket box and tails are stamped from this roll of nickel-copper using known stamping techniques. Holes 82 provide indexing during the stamping process.

From the foregoing description of the preferred embodiment of the invention, it will be apparent that modifications may be made therein. It will be understood, therefore, that this embodiment is intended as an exemplification of the invention and the invention is not limited solely thereto. It should be understood that it is intended in the appended claims to cover all such modifications in the true spirit and scope of the invention.

What is claimed is:

1. An electrical socket comprising: an elongated metal housing being open at at least one end for receiving an electrical pin; one side of said housing having a beam projecting therefrom;

said beam forming an incline with respect to the longitudinal axis of said socket such that said beam is slightly bent inwardly so that the free end of said beam is closer to the longitudinal axis of the housing than its fixed end when the electrical pin is not received in the socket;

an elongated spring member being received in said housing; said spring member being in contact with said free end of said beam;

said beam being compressed outwardly upon the insertion of a pin contact into said socket.

2. An electrical socket as set forth in claim 1 wherein said elongated spring member is elliptical in shape and bowed.

3. An electrical socket as set forth in claim 1 wherein said said elongated spring member is held inside said box by a pair of ears on each end of said elongated spring member, and a pair of slots in each end of said box for receiving said ears.

4. A socket as set forth in claim 1, further including a base on said box-shaped member; said base including a dimple projecting inside said box-shaped member; said elongated spring member being tapered from the middle of said elongated spring member towards its opposing ends, with the middle of said spring being approximately at the same longitudinal position inside said box-shaped member as said dimple.

5. An electrical socket as set forth in claim 1, wherein said elongated spring member is made from a phosphorus-bronze alloy.

6. An electrical socket as set forth in claim 1 further including a carrier and a plurality of said electrical sockets; means for coupling said plurality of electrical sockets to said carrier.

7. An electrical socket as set forth in claim 1 further including a metallic tail extending from one end of said box; a slot in said tail for terminating an electrical conductor thereto.

8. An electrical socket comprising:

an elongated metal box having two side walls, a base and a top portion;

a pair of cantilevered beams integral with said top portion and having free ends projecting away from said top portion at an angle;

a substantially elliptical spring member having two end portions and mid-portion;

means for securing said spring member inside of said box; said mid-portion of said spring member being closer to said base than said end portions;

said free ends of said cantilevered beams being in contact with said substantially elliptical spring member near said end portions whereby upon insertion of a pin into said socket, said elliptical spring member and said cantilevered beams are deflected, causing said end portions of said elliptical spring to slide near said free ends of said cantilevered beams, thereby providing substantial force on said pin by the combined action of said elliptical spring member and said cantilevered beams.

9. An electrical socket as set forth in claim 8 further including a carrier system including:

a plurality of electrical sockets; said sockets being open on both ends; each end adapted to receive a pin contact;

a carrier including a pair of elongated rails;

each socket having a corresponding pair of tails extending from respective ends of said socket;

each of said tails integral with one of said rails;

at least one of said sockets having at least one of its tails offset from the longitudinal axis of said socket.

10. An electrical socket and carrier system as set forth in claim 9 further including a slot in at least one tail extending from each socket; said slot adapted to receive and terminate an electrical conductor.

11. An electrical socket and carrier system as set forth in claim 9 whereby said carrier; said tails and at least a portion of said sockets are made from the same material.

12. An electrical socket and carrier system as set forth in claim 11 wherein said material is a nickel-copper alloy.

13. An electrical socket comprising:

an elongated box-shaped metallic member;

said box-shaped member being opened on at least one end for receiving an electrical pin contact;

a first spring means received in and held in said box-shaped member adapted to make spring contact with the pin;

said first spring means having a pair of opposing free ends;

a second spring means formed as a pair of beams, one end of each of said beams attached to said box-shaped member;

a portion of said other end of each of said beams adapted to contact said first spring means near at least one of its opposing free ends, said second spring means providing additional spring force for enhancing the electrical and mechanical contact between said socket and the pin contact;

each of said beams being a cantilevered beam and being integral with said box-shaped member;

said box including a top portion which is substantially parallel to the longitudinal axis of said socket, said top portion covering only a part of a side of said socket;

said pair of cantilevered beams integral with said top portion and projecting away from said top portion forming free ends;

said beams forming an incline with respect to said top portion, said free ends of said cantilevered beams being in contact with a portion of said first spring means.

14. An electrical socket comprising:

an elongated box-shaped metallic member;

said box-shaped member being open on at least one end for receiving an electrical pin contact;

a bowed spring member received in said box-shaped member adapted to make spring contact with the pin; said bowed spring member having two opposing free ends;

means for holding said bowed spring member inside said box-shaped member;

a pair of cantilevered beams each having one end integral with said box-shaped member and having the other end projecting away from its attachment to said box-shaped member, said other end adapted to contact said bowed spring member near one of the opposing free ends of said bowed spring member;

said cantilevered beams providing additional spring force for enhancing the electrical and mechanical contact between said socket and the pin;

said box includes a top portion which is substantially parallel to the longitudinal axis of said socket, said top portion covering only a part of a side of said socket;

said pair of cantilevered beams being integral with said top portion forming free ends, said beams forming an incline with respect to said top portion.

* * * * *